US009663205B2

(12) United States Patent
Poischbeg et al.

(10) Patent No.: US 9,663,205 B2
(45) Date of Patent: May 30, 2017

(54) FOOT BRACE ASSEMBLY

(71) Applicant: Sea-Dog Corporation, Everett, WA (US)

(72) Inventors: Matthias Poischbeg, Everett, WA (US); Mark A. Nysether, Arlington, WA (US); R. Lee Rawls, Woodinville, WA (US)

(73) Assignee: Sea-Dog Corporation, Everett, WA (US)

( * ) Notice: Subject to any disclaimer, the term of this patent is extended or adjusted under 35 U.S.C. 154(b) by 0 days.

(21) Appl. No.: 14/814,281

(22) Filed: Jul. 30, 2015

(65) Prior Publication Data

US 2016/0176490 A1 Jun. 23, 2016

Related U.S. Application Data

(60) Provisional application No. 62/030,991, filed on Jul. 30, 2014.

(51) Int. Cl.
*B63H 16/02* (2006.01)
*B63B 35/71* (2006.01)

(52) U.S. Cl.
CPC ..... *B63H 16/02* (2013.01); *B63B 35/71* (2013.01); *B63B 2035/715* (2013.01)

(58) Field of Classification Search
CPC ... B63H 16/02; B63B 35/71; B63B 2035/715; A63B 22/0076; A63B 69/06; A63B 2069/068
USPC ..... 114/153, 347, 363
See application file for complete search history.

(56) References Cited

U.S. PATENT DOCUMENTS

| | | | | |
|---|---|---|---|---|
| 3,982,293 | A * | 9/1976 | Lagervall | B63H 16/02 114/363 |
| 4,744,327 | A * | 5/1988 | Masters | B63B 35/71 114/347 |
| 4,942,840 | A * | 7/1990 | Masters | B63H 16/02 114/347 |
| 6,523,492 | B1 * | 2/2003 | Neckar | B63H 16/02 114/347 |
| 7,168,388 | B2 * | 1/2007 | Nysether | B63B 17/00 114/153 |
| 2015/0122170 | A1 * | 5/2015 | Robbins | B63B 17/00 114/363 |

* cited by examiner

*Primary Examiner* — Ajay Vasudeva
(74) *Attorney, Agent, or Firm* — Christensen O'Connor Johnson Kindness PLLC

(57) ABSTRACT

A channel member is adapted for mounting on a watercraft with a foot component slidable along the channel. A latch component is mounted on the foot component by a tongue extending through a slot between a base part of the foot component and a footrest part. The latch also has a tooth to engage with openings in the channel for adjustment of the position of the footrest. A handle portion of the latch component can be flexed to free the tooth from a channel opening, whereupon the foot component can be slid to a desired position and the handle released to lock the foot component in the adjusted position. The footrest can have differently contoured sides for engagement by a foot of a user, and the three foot brace parts (the channel, foot component, and latch component) can be manually separated and reassembled with the either of the contoured sides facing the user.

2 Claims, 7 Drawing Sheets

FOOT BRACE ASSEMBLY

CROSS-REFERENCE TO RELATED APPLICATION

This application claims the benefit of Provisional Application No. 62/030,991, filed Jul. 30, 2014, the disclosure of said application is hereby expressly incorporated by reference herein.

BACKGROUND

In a personal watercraft, such as a kayak, a user typically braces his or her feet against footrests that project from the hull of the craft. Often, the positions of the footrests can be adjusted to accommodate users of different heights. See, for example, U.S. Pat. No. 4,942,840, which shows an adjustable foot brace in a conventional kayak.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention provides a foot brace assembly having a channel, a foot component slidable along the channel, and a latch component mounted on the foot component. The latch component has a tongue extending through a slot between a base part of the foot component and a footrest part. The latch also has a tooth to engage with openings in the channel for adjustment of the position of the footrest. A handle portion of the latch component can be flexed to free the tooth from a channel opening, whereupon the foot component can be slid to a desired position and the handle released to lock the foot component in the adjusted position. The footrest can have differently contoured sides for engagement by a foot of a user, and the three foot brace parts (the channel, foot component, and latch component) can be manually separated and reassembled with the either of the contoured sides facing the user.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
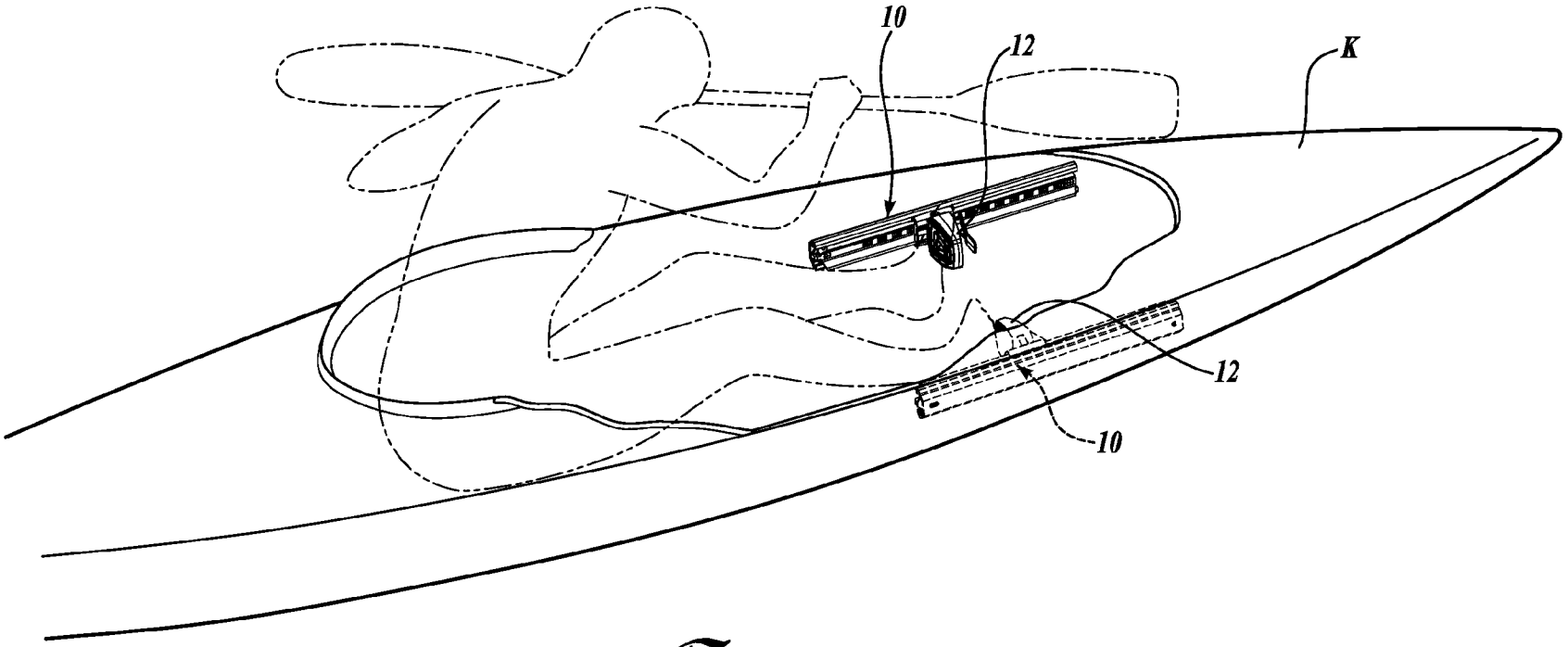
FIG. 1 is a diagrammatic perspective of a foot brace assembly in accordance with the present invention as mounted in a watercraft, namely, a kayak.

With reference to FIG. 1, a foot brace assembly 10 in accordance with the present invention is intended to be mounted in/on a watercraft, such as a kayak K. The brace assembly 10 has a footrest 12 that is adjustable fore and aft. The footrest can be locked in a desired adjusted position. Two such foot brace assemblies are provided, one at the left (port) side and one at the right (starboard) side. The right foot brace assembly is illustrated in broken lines toward the bottom of FIG. 1 and is shown in detail in FIGS. 2-7. The left foot brace assembly is the mirror image of the right.

Figure 2:
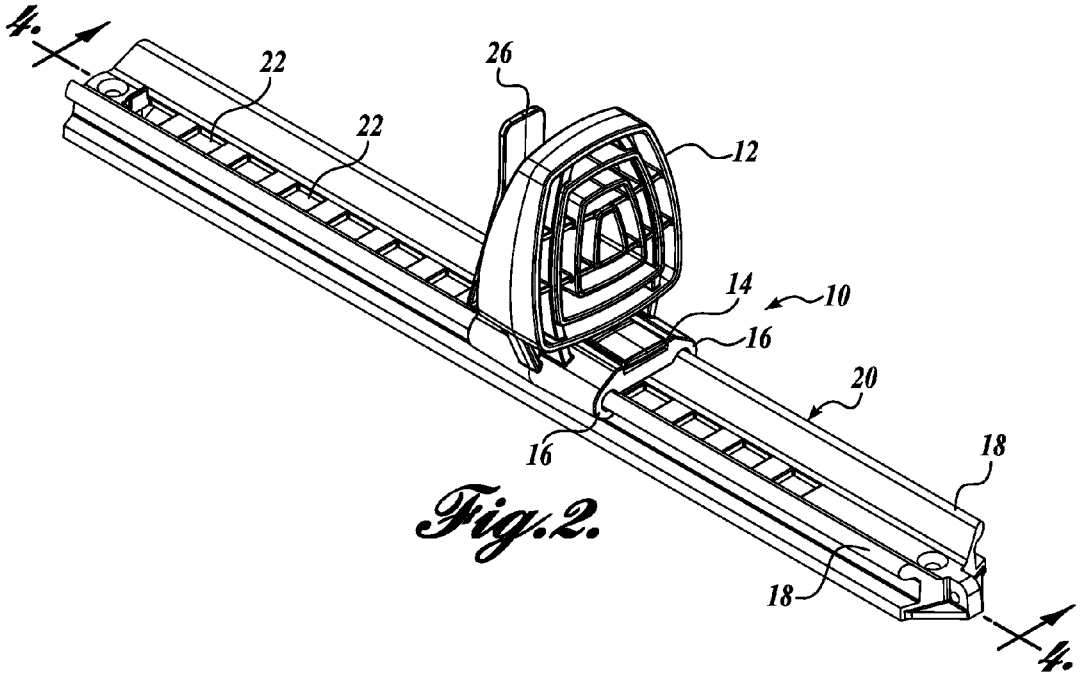
FIG. 2 is an interior side, rear perspective of the foot brace assembly removed from the kayak.
Figure 3:
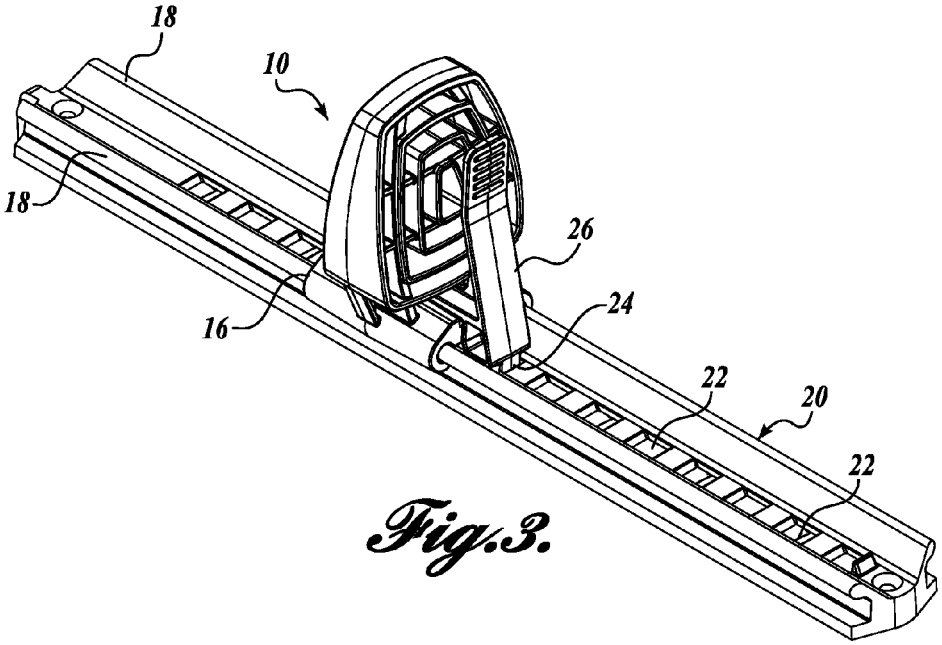
FIG. 3 is an interior side, front perspective of the foot brace assembly removed from the kayak.

Referring to FIGS. 2 and 3, the footrest 12 projects from an integral base 14 having hooked sides 16 for guiding the base and footrest along the top and bottom rails 18 of an elongated slide channel 20. The bottom of the channel has a row of uniformly spaced slots or openings 22 sized and shaped to receive a downward projecting tooth 24 (FIG. 3) of a latch member 26 which is carried by the footrest and base 12, 14.

Figure 4:
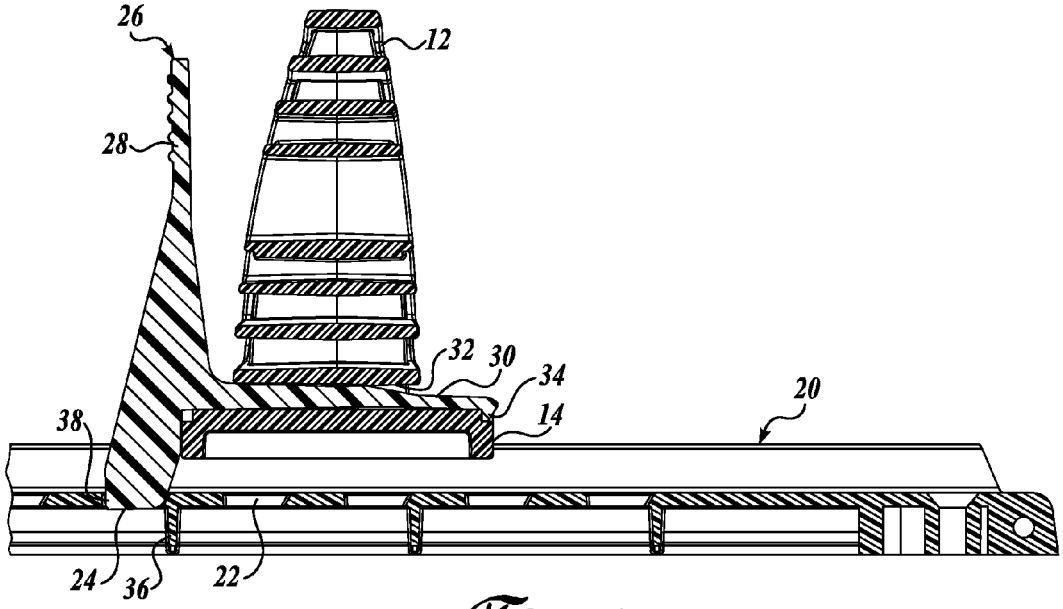
FIG. 4 is a longitudinal section taken along line 4-4 of FIG. 2.
Figure 5:
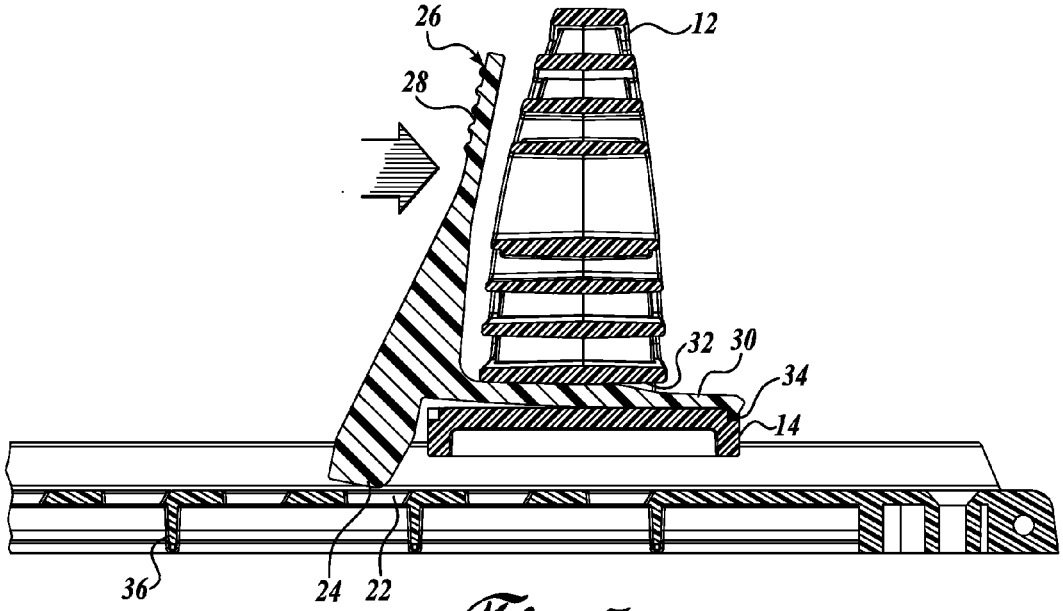
FIG. 5 is a longitudinal section corresponding to FIG. 4 but with parts in different positions.

More specifically, as best seen in FIGS. 4 and 5, the latch member 26 is generally T-shaped, including an upper handle portion 28, the downward projecting latch tooth 24, and a horizontal tongue component 30. The tongue fits in a slot 32 between the footrest 12 and its base 14. The free end of the tongue has a hooked end 34 which normally is tightly fitted in a notch or cutout of the base to lock the tongue in position. The latch tooth 24 is normally fitted in a slot 22 of the channel 20. However, as represented in FIG. 5, the tongue 30 of the latch member 26 is sufficiently resilient that the upper handle portion can be squeezed rearward, toward the footrest 12, so as to free the latch tooth 24 from its slot 22 and allow the footrest-base unit to be slid to an alternative location. In addition, the latch tooth and slots are contoured to allow adjustment of the footrest in one direction without manually actuating the latch. As best seen in FIG. 5, the trailing edges of the slots are inclined, and the trailing edge of the latch tooth 24 is inclined in addition to being slightly rounded at its bottom rear corner. The result is that pulling on the footrest (without manually actuating the latch), toward the right in the orientation of FIG. 4 and FIG. 5, will wedge the latch tooth from its slot and allow it to click into the next adjacent slot. In the other direction, however, the square edge 38 of the latch tooth butts against the square edge of the slot to prevent inadvertent release of the latch in that direction (i.e., the direction of applied force by the foot of a user).

Figure 6:
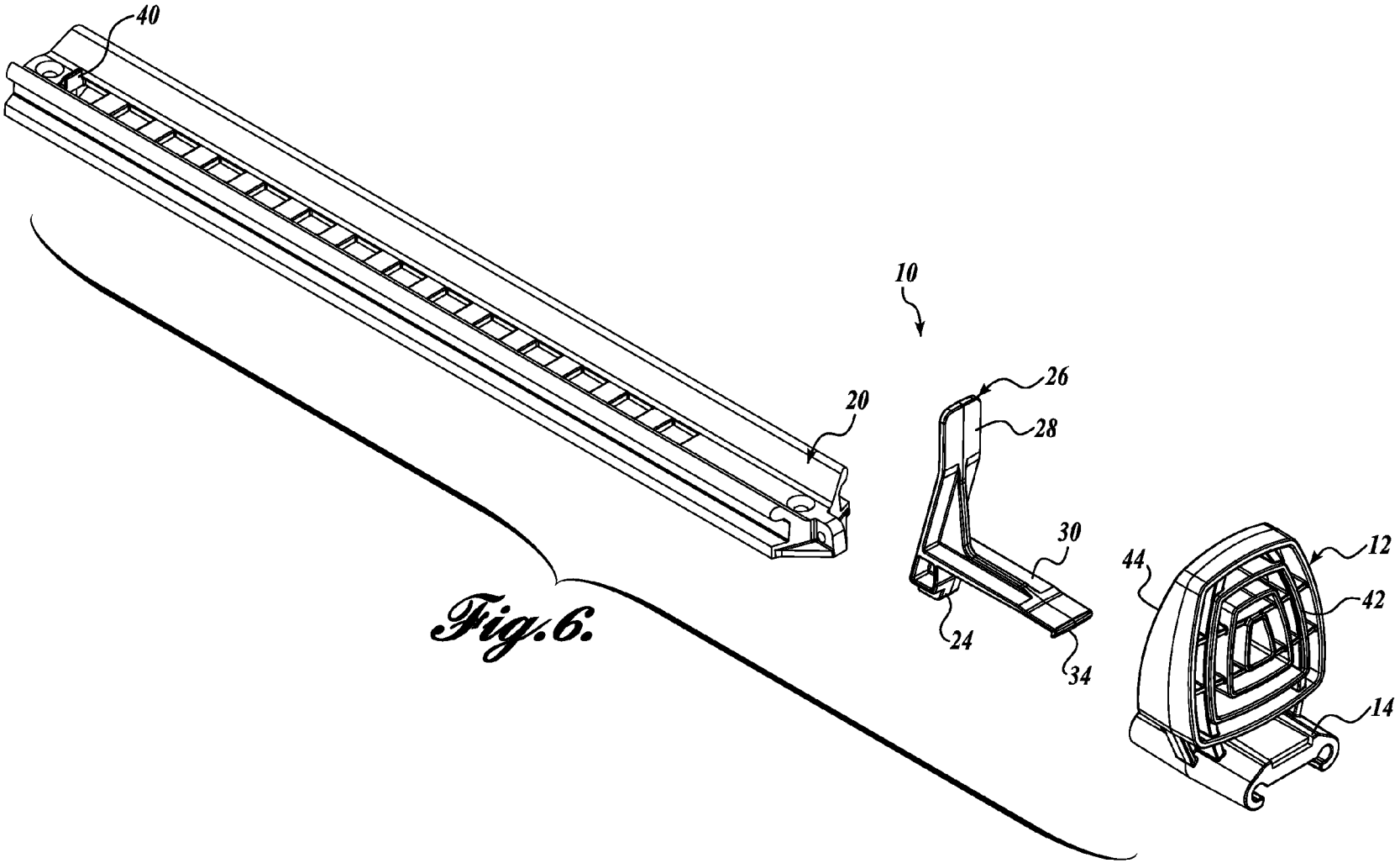
FIG. 6 is an interior perspective of the foot brace assembly with parts shown in exploded relationship.
Figure 7:
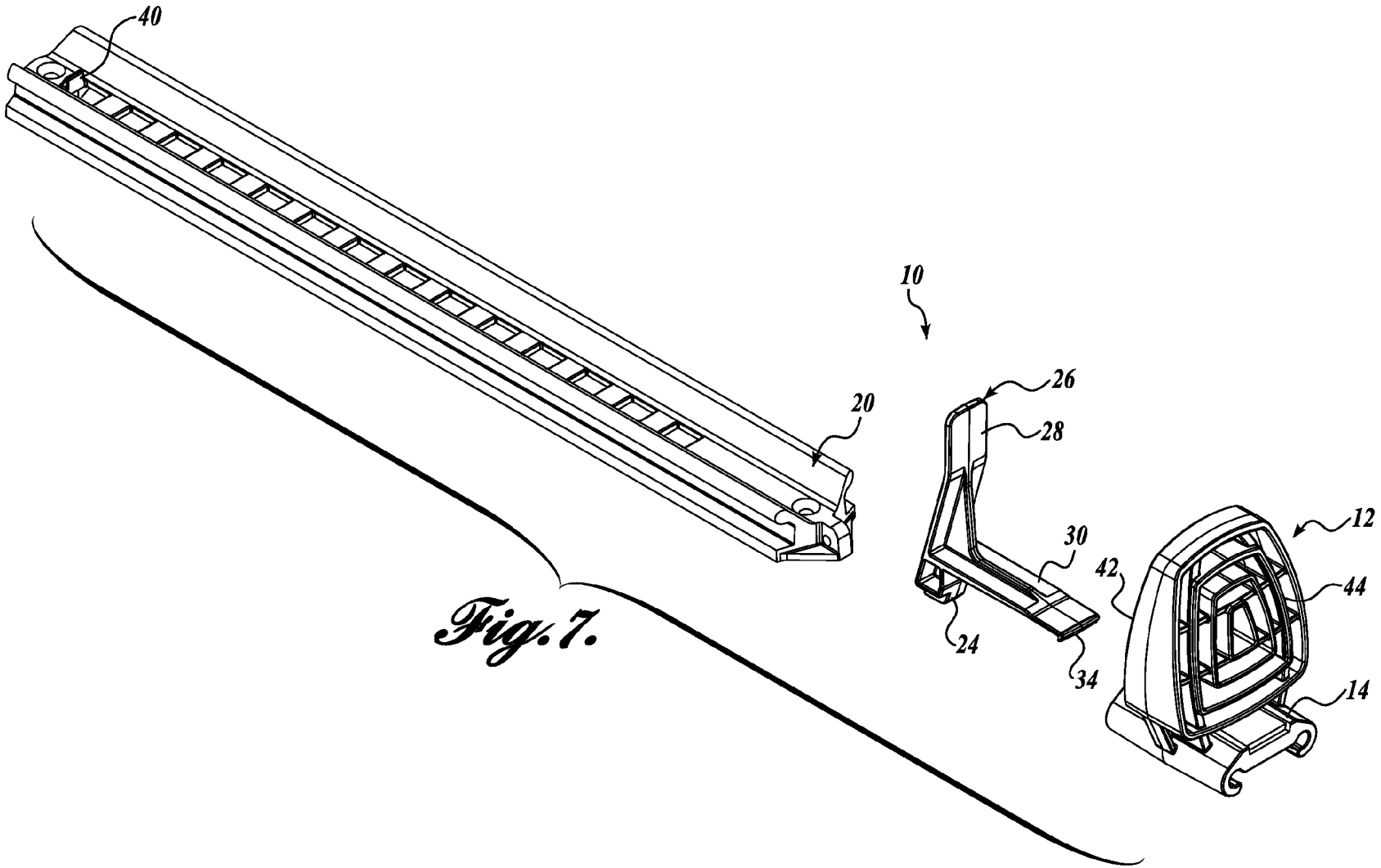
FIG. 7 is an interior perspective corresponding to FIG. 6 but with parts in different positions.

With reference to FIG. 6, the brace assembly 10 can be manually separated into its three component parts consisting of the footrest-base unit 12, 14, latch member 26, and channel member 20. This is achieved by depressing the latch handle 28 and sliding it and the footrest-base unit off the aft end of the channel member (movement in the opposite direction is limited by an upright stop 40). Then, the free, hooked end 34 of the latch tongue can be lifted upward which allows the latch member to be slid away from and off the footrest-base unit. One advantage of this construction is that the footrest portion 12 can be formed with different contours at its opposite sides. In the illustrated embodiment, one side 42 is more flat and more nearly perpendicular to the base than the other side 44 which is contoured differently by being more rounded, particularly at its outer portion. Depending on the preference of the user and the fit of the brace assembly in a particular watercraft, one contour may be more comfortable or practical than the other, and a brace assembly in accordance with the present invention allows the footrest-base unit to be reversed so that a desired side is presented to the user, contoured differently than the opposite side. For example, FIG. 7 shows the footrest reversed from the position of FIG. 6.

Figure 8:
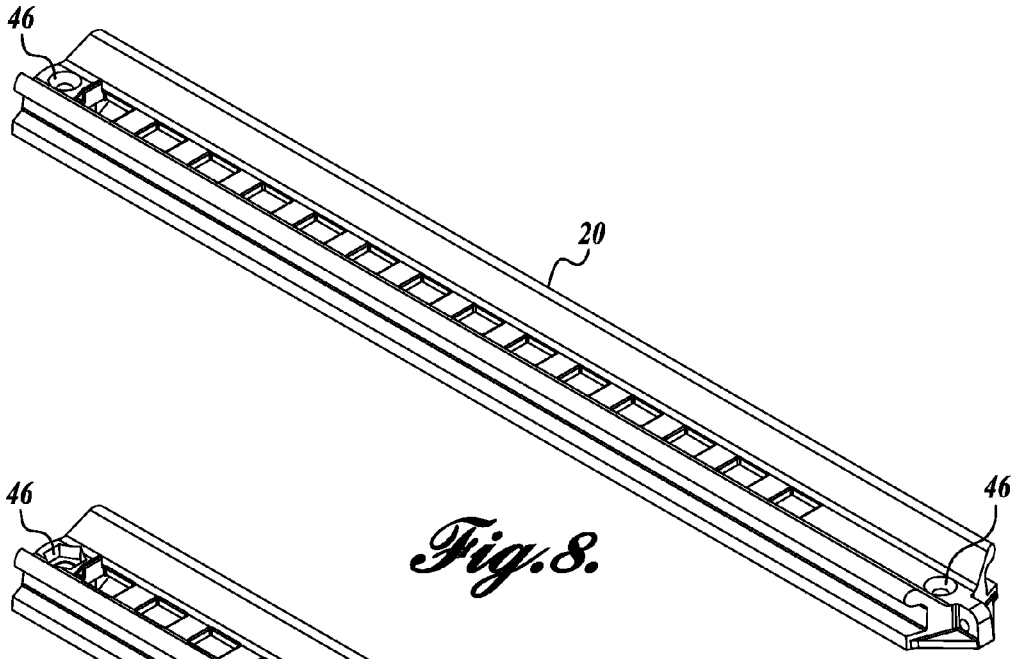
FIG. 8 is an interior perspective of a channel component of a foot brace in accordance with the present invention.
Figure 9:
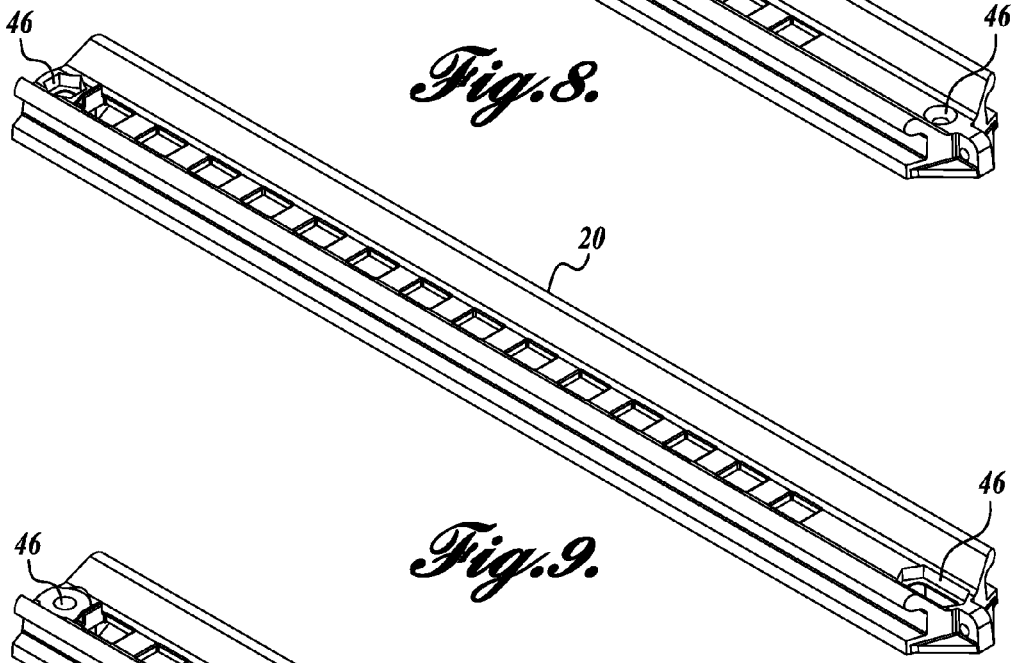
FIG. 9 is an interior perspective of an alternative channel component for a foot brace assembly in accordance with the present invention.
Figure 10:
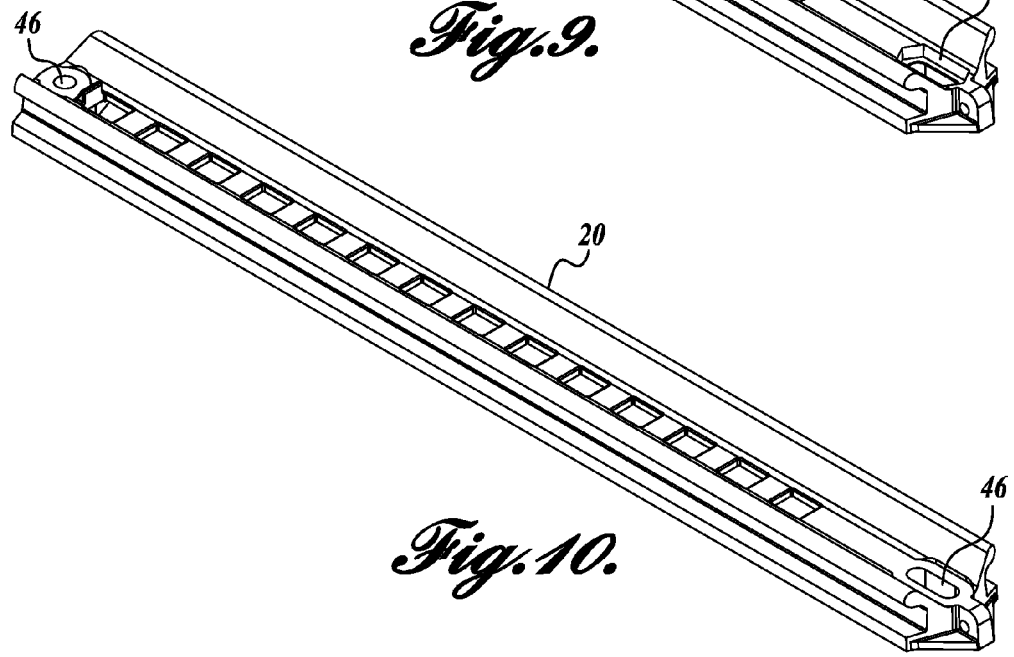
FIG. 10 is an interior perspective of yet another channel component member for a foot brace assembly in accordance with the present invention.

FIGS. 8, 9, and 10 show modifications for the channel unit 20. Such units differ only in the mounting holes 46 provided toward the opposite ends of the channels. FIG. 8 shows holes adapted for use of a self-tapping screw applied from the inside of the watercraft. FIG. 9 shows holes appropriate for a through-hull bolt with a hex nut at the inside. The arrangement of FIG. 10 is appropriate for an installation where the kayak has studs projecting into the interior for reception of mounting nuts or clips. In all cases, the rails and slot arrays are identical to accommodate the same footrest-base-latch member mechanism described above. All parts of the base assembly can be rigid plastic, but the tongue of the latch is dimensioned for a slight resilient bending to allow the operations described above.

Figure 11:
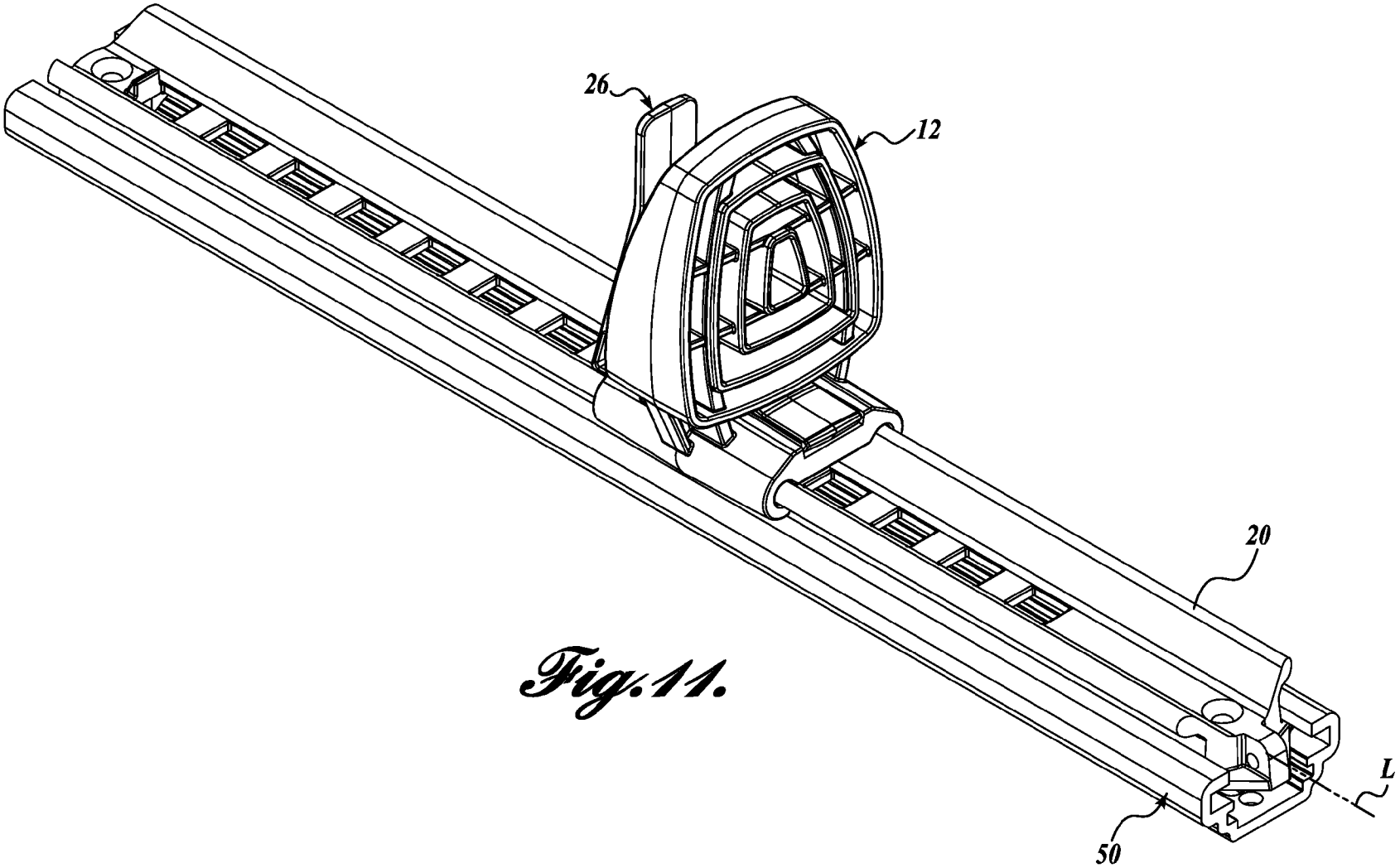
FIG. 11 is an interior perspective of a foot brace assembly in accordance with the present invention and including an additional extrusion guide member for application of the foot brace assembly with a control cable or line.

With reference to FIG. 11, in some applications, the channel 20 will not be rigidly secured to a hull. Rather, a separate extrusion 50 is secured to the hull, and the foot brace assembly is slidably mounted therein, such as for actuation of a control cable or line L, which can be part of a steering mechanism for rudder positioning. Bottom flanges of the channel fit in grooves of the extrusion, with the extrusion being the member secured to the hull and the channel slidable therein.

While illustrative embodiments have been illustrated and described, it will be appreciated that various changes can be made therein without departing from the spirit and scope of the invention.

The embodiments of the invention in which an exclusive property or privilege is claimed are defined as follows:

1. A foot brace assembly for a watercraft, comprising:

an elongated component for mounting on a watercraft, the elongated component defining a channel with a length of the channel extending fore and aft, the channel having longitudinally spaced, uniformly shaped openings exposed at an interior side of the channel;

a foot component having a base fitted on the channel for guided, selective sliding movement therealong, the foot component having a footrest integral with and projecting from the base in a direction away from the channel, the foot component having a through slot between the base and the footrest extending lengthwise relative to the length of the channel; and a stiff but manually flexible latch component having:

a tongue extending through the foot component through slot, the tongue having a free end portion interfitted with the foot component for normally retaining the tongue in the through slot;

a tooth integral with and carried by the tongue, the tooth being normally engaged in one of the uniformly shaped openings of the channel for retention therein; and a handle portion integral with and extending from the tooth, the handle portion extending alongside but being spaced from the footrest, the tooth, the tongue, and the handle portion being constructed and arranged relatively for selective flexing of the handle portion by a user in a direction to result in disengaging the tooth from the channel for adjustment of the foot component and its footrest relative to the channel;

wherein the footrest has opposite sides with different contours configured for engagement by a foot of a user, and wherein the foot component is configured to be selectively fitted on the channel in opposite orientations.

2. The foot brace assembly defined in claim 1, in which the foot component is constructed and arranged to be separable from the channel by manual flexing of the handle portion of the latch component to disengage the tooth from the one of the uniformly shaped openings of the channel, followed by sliding the foot component off of the channel, and in which the tongue and the foot component are constructed and arranged to be thereafter separable from each other by flexing the tongue free end portion so as to disengage the tongue free end portion from the foot component and allow the latch component to be slid out of the through slot and be freed from the foot component.

* * * * *